US006568836B2

(12) United States Patent
Wahl

(10) Patent No.: US 6,568,836 B2
(45) Date of Patent: May 27, 2003

(54) TRACK MOUNTING SYSTEM

(75) Inventor: Michael Wahl, Troy, OH (US)

(73) Assignee: Midmark Corporation, Versailles, OH (US)

( * ) Notice: Subject to any disclaimer, the term of this patent is extended or adjusted under 35 U.S.C. 154(b) by 100 days.

(21) Appl. No.: 09/955,878

(22) Filed: Sep. 19, 2001

(65) Prior Publication Data

US 2003/0053311 A1 Mar. 20, 2003

(51) Int. Cl.[7] ..... F21S 8/06

(52) U.S. Cl. ..... 362/404; 362/418; 362/371; 362/804; 362/285; 248/298.1; 248/343

(58) Field of Search ..... 362/404, 410, 362/418, 285, 147, 370, 371, 389, 396, 804; 248/323, 342, 343, 298.1

(56) References Cited

U.S. PATENT DOCUMENTS

| | | | | | |
|---|---|---|---|---|---|
| 3,065,334 | A | | 11/1962 | Hillenbrand et al. | 240/4 |
| 3,729,627 | A | | 4/1973 | Littell | 240/4 |
| 3,936,671 | A | | 2/1976 | Bobrick et al. | 240/46.59 |
| 3,950,086 | A | | 4/1976 | Schulman et al. | 353/74 |
| 4,032,775 | A | | 6/1977 | Bobrick et al. | 240/73 R |
| 4,097,919 | A | | 6/1978 | Bobrick et al. | 362/270 |
| 4,441,145 | A | * | 4/1984 | Antkowiak | 362/384 |
| 4,538,214 | A | | 8/1985 | Fisher et al. | 362/147 |
| 4,659,048 | A | | 4/1987 | Fahrion | 248/285 |
| 4,821,162 | A | * | 4/1989 | Ellis | 362/408 |
| 4,975,817 | A | | 12/1990 | Reimers | 362/418 |
| 4,984,880 | A | | 1/1991 | Mori | 350/616 |
| 5,128,847 | A | * | 7/1992 | Lin et al. | 362/226 |
| 5,249,881 | A | | 10/1993 | Austin, Jr. et al. | 403/378 |
| 5,340,072 | A | | 8/1994 | Halbirt | 248/279 |
| D377,227 | S | | 1/1997 | Nordstrom et al. | D26/65 |
| 5,651,611 | A | | 7/1997 | Weiler | 362/303 |
| 5,768,876 | A | | 6/1998 | Messing | 57/281 |
| 6,092,774 | A | | 7/2000 | Choy | 248/298.1 |
| 6,312,140 | B1 | * | 11/2001 | McGuire | 362/250 |

* cited by examiner

*Primary Examiner*—Sandra O'Shea
*Assistant Examiner*—Ali Alavi
(74) *Attorney, Agent, or Firm*—Thomas W. Flynn; Wood, Herron & Evans, LLP

(57) ABSTRACT

A track mounting system for supporting equipment, such as a dental light, includes a pan-shaped carriage which is suspended from the track mounting system and to which the light or other equipment is attached. The track mounting system includes a pair of spaced, parallel tracks which are engaged by rollers rotatably mounted on inner walls of the carriage. At least one of the rollers is formed from a relatively hard material and is concave to mate with the complementary surface on one of the tracks to provide resistance against side loads. Other rollers are formed from a relatively soft material and are convex to provide a light frictional resistance to movement of the carriage along the tracks that inhibits drift, over-travel and other inadvertent movement of the carriage, while reducing noise.

12 Claims, 2 Drawing Sheets

TRACK MOUNTING SYSTEM

BACKGROUND OF THE INVENTION

Track mounted lighting systems are commonly found in various health care examination and treatment facilities, such as medical and dental operations. See, for example, U.S. Pat. Nos. 3,936,671 and 4,975,817. See also, Track Light, Model 6300, offered by A-Dec, Inc., 2601 Crestview Drive, Newberg, Oreg. 97132.

In the latter, a ceiling-mounted track assembly is engaged by rollers carried by a trolley, on which is mounted a light post. The trolley and the light post are thus freely movable along the track assembly. Because of this free movement, the track assembly must be carefully installed and leveled. Otherwise, the trolley and light will tend to drift along the track. Also, when moving the light along the track from one position to another, the free movement of the trolley may result in over-travel, with movement terminated only by the trolley engaging stops at the ends of the track assembly.

As noted in U.S. Pat. No. 4,975,817, a freely movable carriage may be difficult to control, and may in fact, change position inadvertently, in response, for example, to building vibration. Spring-loaded friction pads may retard unwanted movement of a light bearing carriage, but they also render it more difficult to move, and of course, they must be adjusted, and eventually, replaced because of wear. As a solution to this problem, the '817 patent proposes a system of opposed, spring-loaded brakes and a solenoid-actuated release mechanism. Here again, a brake system requires adjustment and eventual replacement of the brake pads, and a power or other failure of the solenoid release mechanism will result in the carriage being locked up against all movement.

It will be seen, therefore, that a need exists for a track light mounting system that is freely movable, yet is not susceptible to drift, over-travel, or other unwanted movement, and that will permit some tolerance in installation, but not rely on friction pads that must be adjusted and replaced or electromechanically actuated braking systems which are susceptible to lockups and other malfunctions.

SUMMARY OF THE INVENTION

The track mounted lighting system of the present invention utilizes hard, concave rollers in engagement with a complementarily shaped track, which in itself, is known, for example, in the Model 6300 Track Light noted above, but in accordance with the present invention, in combination with relatively soft, convex rollers, which exert a light frictional resistance, just sufficient to inhibit drift, over-travel, or other inadvertent movement of the lighting carriage along the track system.

Specifically, the track mounted lighting system of the present invention utilizes pairs of hard and soft, concave and convex rollers, positioned along and engaging upper and lower surfaces of one of the tracks of the system, while individual, soft, convex rollers engage an upper surface of the other of the tracks of the system. The upper surface of the track engaged by the hard, concave rollers, is complementarily configured to the concavity of the concave rollers, as in the above-noted model M6300 Track Light, but the roller-track engagement is maintained by the relatively soft convex rollers, which pair up with the concave, hard rollers and engage the lower surface of the track.

While various materials are available from which the hard and soft rollers may be molded, it has been found that an acetal resin sold under the trademark DELRIN® functions well for the hard, concave rollers, while a urethane formulated to a Shore A durometer rating of about 75 to 95 is satisfactory for the soft, convex rollers, with the urethane having a Shore A durometer rating of approximately 80 functioning satisfactorily.

With this unique combination of hard and soft, concave and convex rollers, resistance to drift, over-travel and other inadvertent carriage movement is avoided, while still providing ease of intentional movement and resistance to side loads. Additionally, it has been found that noise incident to carriage travel in prior art devices is substantially reduced. This is accomplished without resort to the prior art expedients of friction pads or braking systems and their attendant disadvantages.

The above and other objects and advantages of the present invention shall become apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
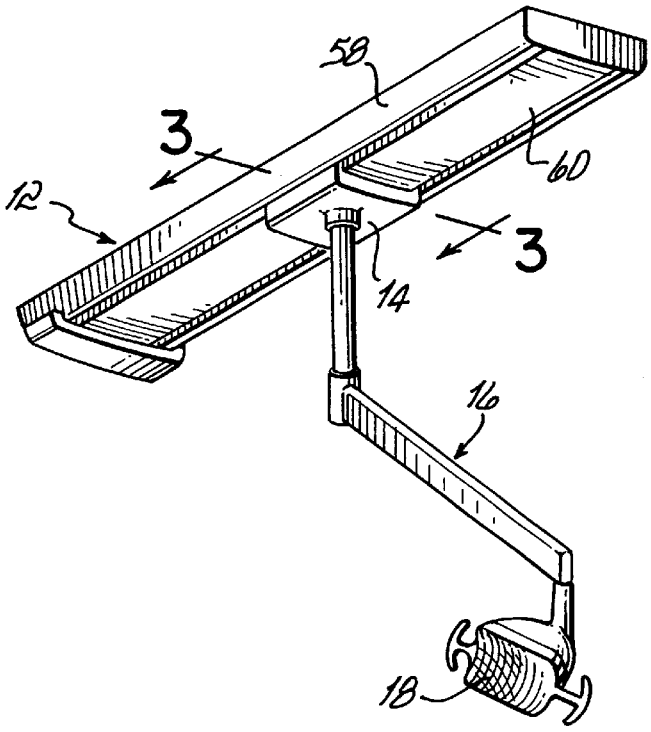
FIG. 1 is a perspective view of a track mounted lighting system.

As seen in FIG. 1 of the drawings, an equipment mounting system 10 in accordance with the present invention may include a track assembly 12 carrying a carriage 14 on which is mounted an articulated arm assembly 16, at the lower end of which is mounted a light 18. It will be apparent that, although the present invention is described in conjunction with a light mounting system, such as a dental light, the present application has application to track mounted equipment in general such as, for example, an x-ray machine.

Figure 2:
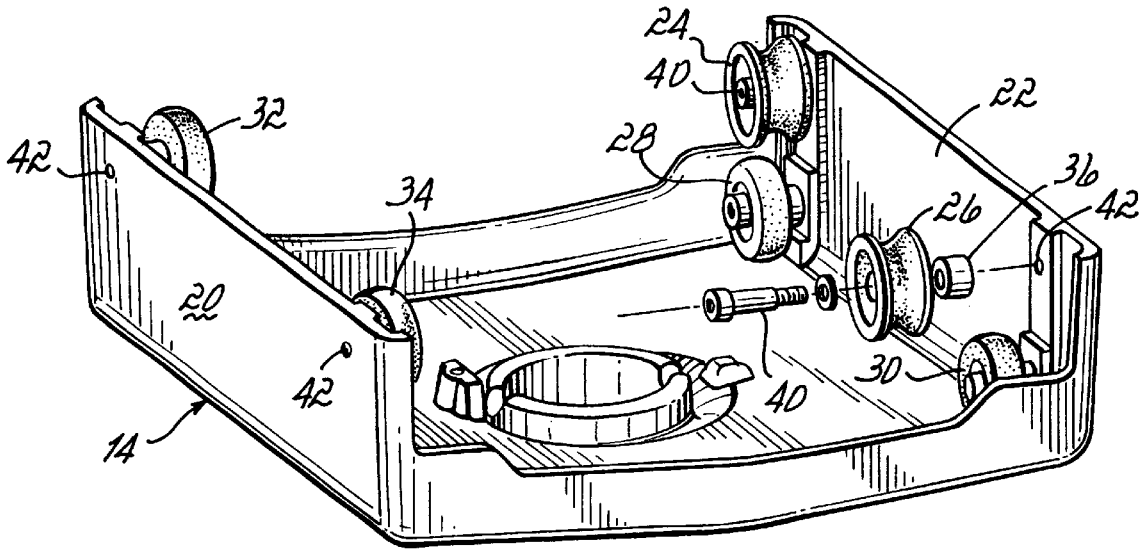
FIG. 2 is a perspective view of a carriage engageable with tracks for movably mounting a light.
Figure 3:
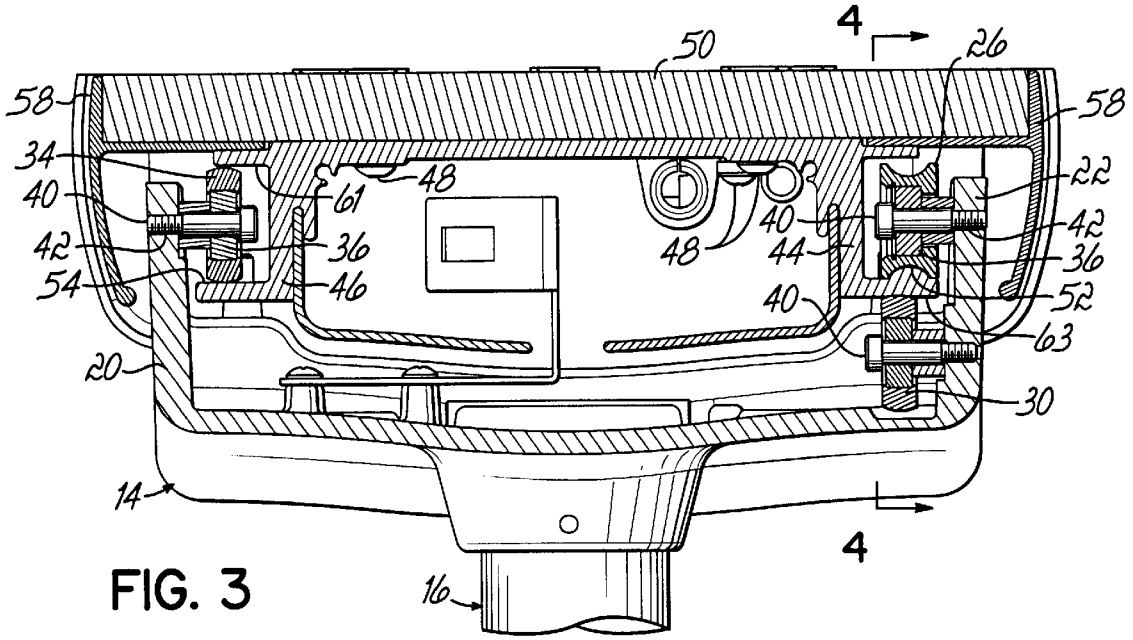
FIG. 3 is a cross-sectional view taken on line 3—3 of FIG. 1.

The carriage 14, as best seen in FIGS. 2 and 3 of the drawings, has upstanding side walls 20 and 22, on the interior surfaces of which are rotatably mounted hard concave rollers 24 and 26, each of which forms a pair with an underlying soft convex roller 28 and 30, respectively. On the opposite side wall 20 are mounted convex, relatively soft rollers 32 and 34. Each of the rollers is provided with a bearing 36 and a threaded axle 40 received in complementary threaded openings 42 in the upstanding side walls 20 and 22. As noted above, an acetal resin sold under the trademark DELRIN® is satisfactory for the hard, concave rollers, while a urethane having a rating of 75 to 95 on the Shore A durometer scale is used for the softer, convex rollers.

With continued reference to FIG. 3 of the drawings, it will be seen that the track assembly includes a pair of spaced parallel tracks 44 and 46 attached by means of bolts or the like 48 to a baseboard 50, which in turn is mounted on a ceiling or other overhead structure. As noted previously, in the absence of the present invention, the utmost care must be taken when attaching the board 50 to a ceiling or other overhead structure to ensure that it is nearly absolutely level to avoid subsequent drift of the carriage and light mounted thereon.

Figure 4:
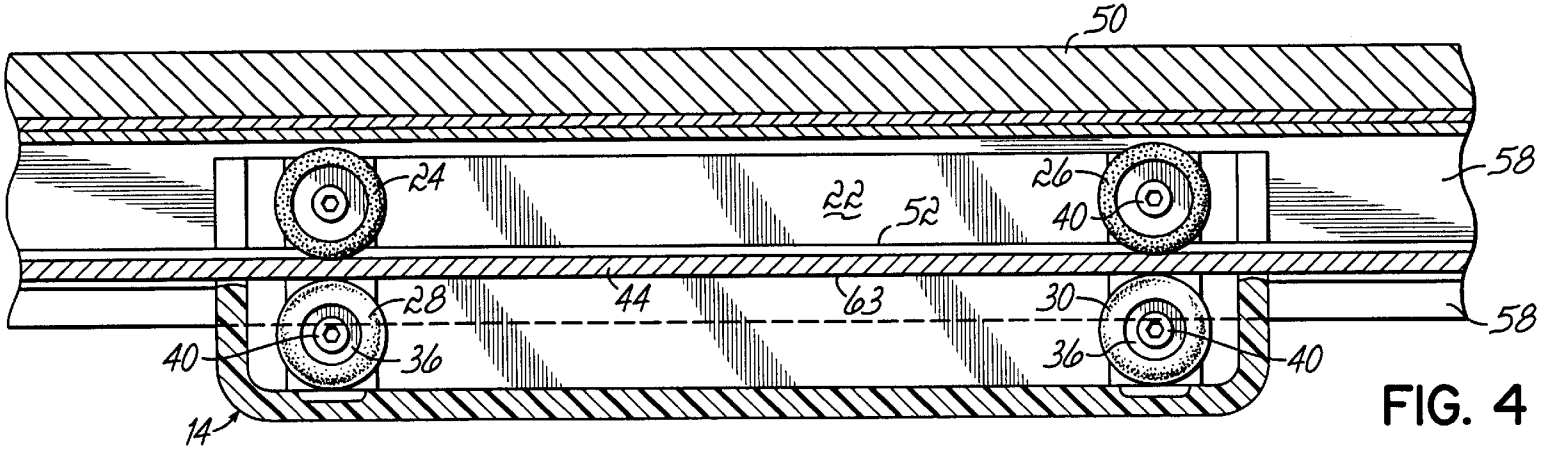
FIG. 4 is a cross-sectional view taken on line 4—4 of FIG. 3.

It will be noted from FIGS. 3 and 4 of the drawings that the track 44 has a portion 52 which is complementary to the concave wheels 24 and 26 to resist side loads applied to the carriage 14, with the wheels 24 and 26 and the portion 52 of the track 44 maintained in an engagement by the underlying, convex, soft rollers 28 and 30, which thereby form operative pairs with the overlying hard convex rollers 24 and 26. Again, as seen in FIGS. 3 and 4 of the drawings, the pairs of concave hard rollers and convex soft rollers engage upper and lower surfaces, respectively of the track 44. Rollers 32 and 34, on the other hand, are in rolling alternative engagement with an upper surface 54 and a lower surface 61 of the track 46 and, in conjunction with the rollers 28 and 30, exert a slight frictional resistance to movement of the carriage 14 along the tracks 44 and 46. The lighting system can pivot, causing its weight to shift. This in turn causes the rollers 32 and 34 to alternate between the upper and lower surfaces 54 and 61.

As best seen in FIGS. 1 and 3, the assembly may be finished with end covers, such as are shown in FIG. 1 at 56 and side covers 58, as well as a bottom cover 60.

From the above, it will be seen that the present invention provides a track mounting system in which the carriage is freely movable, yet is not susceptible to drift, over-travel or other unwanted movement, yet permits some tolerance in installation without resort to friction pads or braking systems. While the invention has been described in the context of a track mounted lighting system, it will be understood that the principles thereof are generally applicable to any track mounted system, and that while certain forms of the invention have been illustrated and described, the invention is not limited thereto except in accordance with the following claims.

What is claimed is:

1. In an equipment mounting system, including a pair of spaced, parallel tracks, a carriage, a plurality of rollers rotatably mounted on said carriage and in rolling engagement with said tracks to suspend said carriage from said tracks for rolling movement therealong, the improvement comprising:

at least one of said rollers being concave and formed from a relatively hard material, said concave roller engaging one of said tracks, said track engaged by said concave roller being configured complementarily to the concavity of said concave roller to resist side loads on said carriage, and others of said rollers than said concave roller being formed of a relatively soft material and providing light frictional resistance to movement of said carriage along said tracks; thereby inhibiting drift, over-travel and inadvertent movement thereof.

2. The system of claim 1 wherein:

said rollers formed of a relatively soft material are convex.

3. The system of claim 2 wherein:

said concave roller is paired with a convex roller with the pair of said rollers engaging upper and lower surfaces of said one of said tracks.

4. The system of claim 3 wherein:

multiples of said pair of rollers are in engagement with said one track.

5. The system of claim 4 wherein:

the other of said tracks is engaged by said convex rollers.

6. The system of claim 5 wherein:

said convex rollers engaging said other of said tracks engage an upper surface thereof.

7. The system of claim 3 wherein:

said concave roller is engaged with an upper surface of said one of said tracks.

8. The system of claim 1 wherein:

said concave roller is formed from and acetal resin material.

9. The system of claim 1 wherein:

said others of said rollers are formed from material having a Shore A durometer rating of 75 to 95.

10. The system of claim 9 wherein:

said others of said rollers are formed from material having a Shore A Durometer rating of approximately 80.

11. The system of claim 10 wherein:

said others of said rollers are formed from urethane.

12. A track mounting system comprising:

an elongated track assembly having spaced, parallel, roller-engageable tracks, a carriage having a bottom wall and upstanding side walls suspended from said track assembly for movement therealong, said carriage having spaced pairs of upper and lower rollers rotatably mounted on an inner surface of one of said side walls, said upper rollers being concave and formed of a relatively hard acetal resin, upper and lower surfaces of one of said spaced parallel tracks being engaged by said spaced pair of upper and lower rollers, said upper surface being complementarily contoured to said concave upper rollers to resist side loads, spaced, individual rollers rotatably mounted on an inner surface of the other of said carriage side walls, said rollers other than said concave rollers being formed from material having a Shore A durometer rating of 75 to 95, whereby said other rollers provide light frictional resistance to movement of said carriage along said tracks to inhibit drift, over-travel and inadvertent movement thereof.

* * * * *